United States Patent [19]

Seitzer

[11] 4,410,415

[45] Oct. 18, 1983

[54] REDUCTION IN POUR POINT OF SHALE OIL

[75] Inventor: Walter H. Seitzer, West Chester, Pa.

[73] Assignee: Sunoco Energy Development Co., Dallas, Tex.

[21] Appl. No.: 146,906

[22] Filed: May 5, 1980

[51] Int. Cl.[3] ..... C01G 1/04

[52] U.S. Cl. ..... 208/11 LE; 208/14

[58] Field of Search ..... 208/14, 11 LE

[56] References Cited

U.S. PATENT DOCUMENTS

| | | | |
|---|---|---|---|
| 2,601,257 | 6/1952 | Buchan | 208/11 LE |
| 4,166,023 | 8/1979 | Seitzer | 208/14 |
| 4,172,026 | 10/1979 | Jensen | 208/14 |
| 4,181,177 | 1/1980 | Compton | 208/14 |
| 4,201,658 | 5/1980 | Jensen | 208/14 |

*Primary Examiner*—Charles F. Warren
*Assistant Examiner*—Joseph A. Boska
*Attorney, Agent, or Firm*—J. Edward Hess; Donald R. Johnson; Patrick C. Baker

[57] ABSTRACT

The pour point of shale oil is lowered by contacting with fresh oil shale. The temperature of contacting is preferably below 350° F.

5 Claims, 1 Drawing Figure

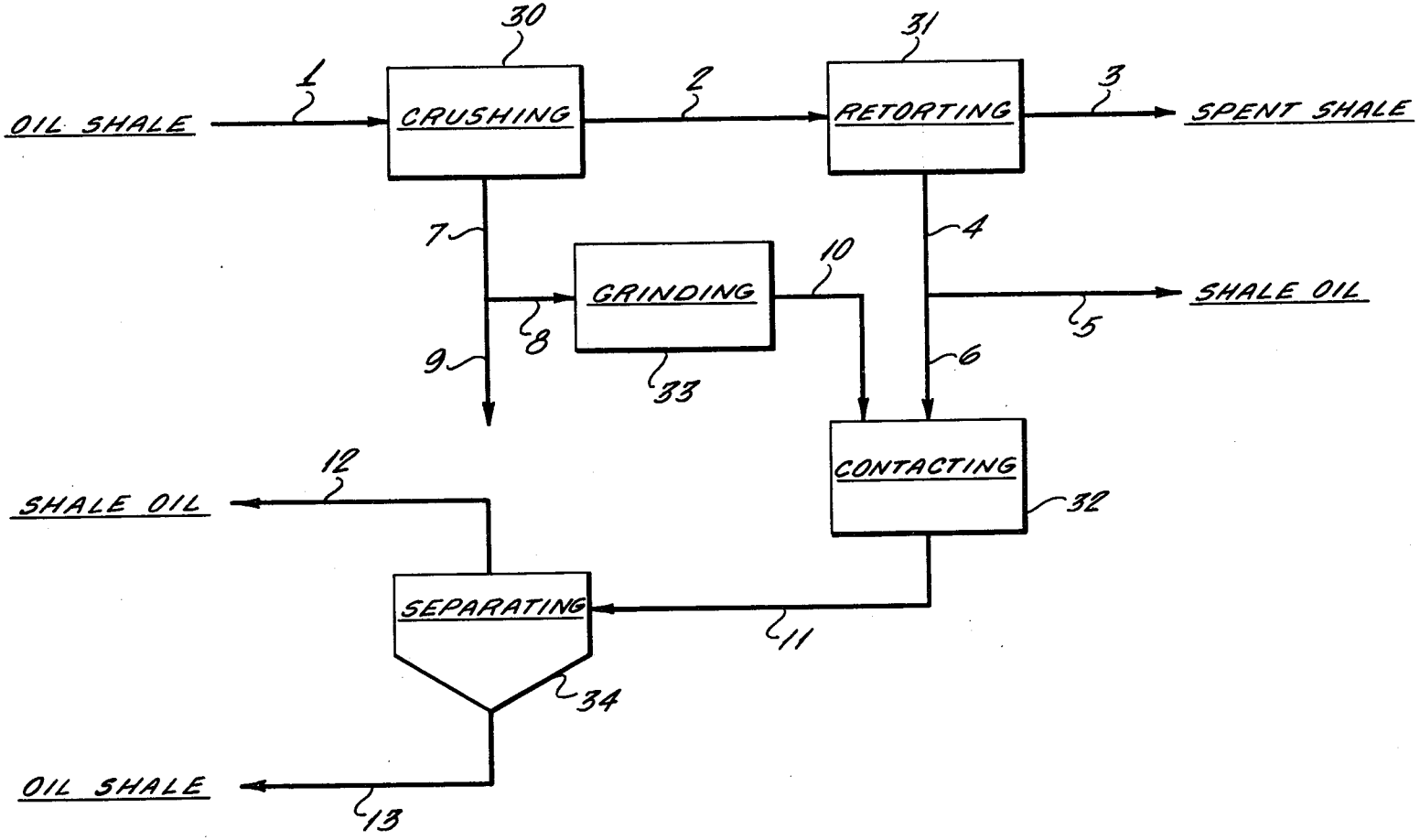
OIL SHALE
1
CRUSHING
30
2
RETORTING
31
3
SPENT SHALE
4
5
SHALE OIL
6
CONTACTING
32
7
8
9
GRINDING
33
10
11
SEPARATING
34
12
SHALE OIL
13
OIL SHALE

REDUCTION IN POUR POINT OF SHALE OIL

FIELD OF THE INVENTION

The present invention is directed to shale oil and a reduction in its pour point. Particularly, the invention is directed to a method for lowering the pour point of a shale oil obtained by retorting oil shale. The method involves contacting the shale oil with fresh (unretorted) oil shale, preferably at elevated temperature. A shale oil product having lower pour point than the initial shale oil may thereafter be separated from the oil shale.

DESCRIPTION OF THE PRIOR ART

A general description of shale oil and how it is obtained from oil shale via various retorting methods is disclosed in such references as Kirk-Othmer, *Encyclopedia of Chemical Technology,* 2nd Edition, Volume 18. Particular methods of obtaining shale oil from oil shale are described in various U.S. patents, of which U.S. Pat. Nos. 3,841,992 and 3,361,644 are representative examples.

Shale oil obtained from a thermal treatment (retorting) of oil shale generally has a pour point which is too high for liquid transportation. The pour point of shale oil, about 60–100° F., is higher than the ambient temperature for many months of the year, and thus the shale oil tends to solidify. And it is expected that the shale oil produced by retorting near the source of the oil shale will have to be transported long distances to the points of refining. One economical means of transporting shale oil is by pipeline. Thus a shale oil having a low pour point and a low viscosity would enhance the economics of moving the oil via pipeline.

U.S. Pat. No. 4,166,023 discloses a method for producing a low pour point shale oil. The method involves adding a 1050° F. plus fraction of a shale oil containing spherulites to a waxy shale oil not containing spherulites whereby the pour point of the resulting mixture is substantially reduced. However, there is no suggestion of reducing pour point of a shale oil by contact with oil shale, rather than with another shale oil.

Also, an article in *Journal of Chemical and Engineering Data,* Vol. 5, No. 1, January 1960, W. E. Robinson et al. is directed to determining the composition of low temperature extracts from oil shale. Oil shale is contacted with tetrahydronaphthalene ($C_{10}H_{12}$), and subsequently with benzene, at various temperatures up to 350° C. Fractions extracted from the oil shale at the various temperatures were characterized as to their hydrocarbon structure and elemental components. However, the article fails to disclose or suggest applicant's method of extracting with shale oil itself and provides no indication that materail extractable from oil shale would lower the pour point of shale oil.

SUMMARY OF THE INVENTION

The present invention involves contacting fresh oil shale with shale oil at an elevated temperature. The shale oil apparently extracts a material or materials from the oil shale which modifies the properties of the shale oil. Included in the modification of the physical properties of the shale oil are the lowering of both the pour point and the viscosity of the raw shale oil. The shale oil treated in applicant's method includes whole shale oil as well as various shale oil fractions. Raw shale oil, (unrefined shale oil as normally obtained from retorting) and its fractions are the typical starting materials, although the invention could also be useful with a treated shale oil having undesirably high pour points.

BRIEF DESCRIPTION OF THE FIGURE

The attached drawing is a schematic representation of one of applicant's embodiments as it relates to a process for improving the flow characteristics of shale oil

DETAILED DESCRIPTION

Referring now to the single figure, mined oil shale is fed by conveyor 1 to a crushing zone 30 wherein the mined oil shale is crushed into smaller pieces in order to enhance subsequent processing. Some of the crushed oil shale is fed from crushing zone 30 via conduit 2 to a retorting zone 31 wherein at an elevated temperature, e.g., 400–500° C., shale oil liquid is formed, and separated, and removed via line 4. Spent oil shale is separated within the retorting zone 31 and removed therefrom via conduit 3. The generally hot shale oil leaving the retorting zone 31 via line 4 can be cooled via heat exchange methods (not shown) and sent to storage tanks (not shown) or for further processing (not shown) via line 5. A portion of the raw shale oil, hot or cooled, can be fed to contacting zone 32 via line 6. In zone 32 the raw shale oil contacts ground oil shale brought into the zone via conduit 10 and which zone is at preferably an elevated temperature.

The ground oil shale fed to the contacting zone 32 via conduit 10 can be obtained from the grinding zone 33 which received some of the smaller pieces of oil shale produced in crushing zone 30 via conduits 7 and 8. Some of the smaller pieces of the oil shale produced may be stock piled (not shown) for subsequent use via conduit 9.

Applicant's method comprises the contacting occurring within contacting zone 32 between the oil shale obtained from grinding zone 33 and the shale oil obtained from retorting zone 31. However, the grinding of oil shale may not be necessary. One alternative is that the crushed oil shale from crushing zone 30 itself may be a satisfactory feed to contacting zone 32. Also, the smaller pieces of oil shale, which often are referred to as fines, obtained from the crushing zone 30 may be a satisfactory alternative feed.

Also as understood by one skilled in the art, the oil feed to the contacting zone 32 need not be obtained directly from the retorting zone 31. The oil feed can be obtained from a storage tank or some other processing unit. Also as indicated before, the oil feed to contacting zone 32 can be a particular shale oil fraction obtained by e.g., distilling shale oil produced in the retorting zone 31. However, economics could favor the simplest method such as using hot retorted oil, obtained directly from retorting zone 31 as fresh feed to contacting zone 32.

In contacting zone 32 the liquid shale oil and fresh oil shale (in contrast to spent oil shale as represented by line 3) contact eath other at, preferably, an elevated temperature. The elevated temperature can vary considerably; however, the upper limit is the temperature at which the extract undergoes severe cracking, that is, the organic molecules break into smaller molecules and carbon as well as gases such as methane. In other words the elevated temperature should not exceed the thermal decomposition temperature of the extracted kerogen contained in the oil shale. Such a temperature generally is no more than about 350° C. (for comparison, the retorting temperature is about 400°-500° C.). Since another factor influencing the economics is the rate at which the desired materials are removed from the oil shale, some temperature higher than ambient temperature would be desirable. A preferred lower limit is about 25° C. Thus a preferred operating temperature range is about 25°-350° C., and a more preferred range is about 50°-300° C. The pressure can vary over a wide range; however, the combination of pressure and temperature would preferably by such that substantially all the oil is in a liquid state.

As previously suggested, the particle size of the oil shale fed via conduit 10 to contacting zone 32 can vary over a wide range. Finer size particles are favored from the standpoint of ease (rate) of removal of the desired materials from the oil shale; however, grinding can be expensive and a large energy consumer. Thus economics could control use of a particular size range with applicant's method. Preferably, the oil shale used would have an average size of about ¼ inch or smaller. The amount of shale oil used in relationship to the oil shale also can vary over a considerable range. However, it would be an effective amount in that it would remove the desired materials in a suitable amount of time. The amount is also influenced by the particle size used and the temperature used. Preferably, the weight ratio of oil to shale would be in the range of between from about 100/1 to about 1/5. The contacting time also could vary over a wide range reflecting the amount of material being treated and particular operating conditions used; however, the time would be sufficient whereby afterwards the pour point of the resulting shale oil is lower than the pour point of liquid feed shale oil prior to the contacting. With a commercial unit contacting times of about five minutes to several hours would be typical.

The means for contacting the oil shale and shale oil include a stirred reactor, a fixed bed, a fluid bed, and other means known to those skilled in the art. The method could also be batch or continuous.

After the contacting in contacting zone 32 the contacting mixture of oil shale and shale oil can be transferred to separation zone 34 via line 11. In separating zone 34 the shale oil is separated from the oil shale by various known means (not shown). The separated shale oil can be transferred by line 12 to suitable storage (not shown) or to a pipeline (not shown). The separated oil shale, which may be coated with shale oil, could be forwarded via conduit 13 to a retorting section or handled in some other suitable manner. The separated shale oil could also be blended with more fresh shale oil and reduce the pour point of the latter.

What happens in contacting zone 32 is not fully understood; however, the following seems to be a reasonable hypothesis. As is well known, shale oil, obtained directly from the retorting of the oil shale, generally has a relatively high pour point. When the liquid shale oil comes in contact with the oil shale within the previously defined temperature range, it extracts an organic material or materials from the fresh oil shale which have the desirable effect of lowering the pour point of shale oil used to contact the oil shale. The organic material or materials extracted from the oil shale can be considered as natural occurring pour point depressants or viscosity reducing additives. (Such synthetic depressants or additives are known but generally they are chemically well defined compounds, e.g., polymethacrylates). The extract material is believed to be an organic type material, and the data, discussed hereinafter, suggest that a small quantity of the material when mixed with the high pour point shale oil will lower its pour point substantially. In one example the pour point of raw Union shale oil was lowered by 35° F. and even greater effects, for example, 50° F. may be possible. Also the lowering pour point effect can be obtained even if the pour point of the raw shale oil is relatively low, for example, 0° F. And as stated before, a lower pour point shale oil is highly desirable because it facilitates pumping. Further it is believed that the higher retorting temperature, i.e., 400°-500° C., destroys or converts in some fashion the naturally occurring pour point depressant or depressants. Thus the retorting process inherently tends to destroy any tendency for the raw shale oil to have a lower pour point.

Thus in summary, applicant's method is a process for improving (lowering) the pour point of shale oil comprising contacting fresh oil shale and an effective amount of feed shale oil. The contacting occurs at, preferably, an elevated temperature not exceeding the cracking temperature of the kerogen extracted from the oil shale during the contacting. The contacting also occurs for a sufficient time whereby afterwards the pour point of the resulting shale oil is lower compared to the pour point of the feed shale oil prior to the contacting.

The following examples are given to specifically illustrate embodiments of the method of the invention.

EXAMPLES

Utah 32 GPT (gallons of oil per ton of shale by Fisher Assay) shale was ground to pass through a 100 mesh sieve and charged as a weight ratio of 2 parts of oil shale to 55 parts of shale oil. The resulting mixture was heated in a closed container to 300° C. and held at that temperature for one hour. The mixture was cooled and the shale separated from the resulting oil. The following Table I shows the changes in the properties of the shale oil as a result of contact with the shale at an elevated temperature.

TABLE I

Improvement in Properties Of Shale Oil Caused By Contacting with Oil Shale

| | Pour Point, °C. | Apparent Viscosity (Centipoises @ 10° C. and 50 $sec^{-1}$ shear rate) |
|---|---|---|
| Untreated Shale Oil | 25 | 1530 |
| Shale Oil after Treatment | −2 | 650 |

Comparison of pour points and viscosity indicate that applicant's method improves the liquid qualities of the shale oil.

Other runs were performed in a similar manner as to the previously described one; however, different oils and different weight ratios of shale to oil were used. Also the contacting temperature was lower, 250° C. vs. 300° C. while contacting was for 2.5 hours vs. 1 hour. The results are shown in Table II.

TABLE II

Improvement in Shale Oil Caused by Contacting with Oil Shale

| | Charge-grms. | | Operating Conditions | | |
|---|---|---|---|---|---|
| Oil Source | Shale | Oil | Temperature | Time-hrs. | Pour Point °C. |
| Paraho | — | — | — | — | 25 |
| Paraho | 70 | 75 | 250 | 2.5 | −3 |
| Union | — | — | — | — | 17 |

TABLE II-continued

| Oil Source | Improvement in Shale Oil Caused by Contacting with Oil Shale: Charge-grms. Shale | Charge-grms. Oil | Operating Conditions Temperature | Operating Conditions Time-hrs. | Pour Point °C. |
|---|---|---|---|---|---|
| Union | 50 | 50 | 250 | 2.5 | −18 |

In both of the comparisons in Table II applicant's method resulted in a substantial decrease in pour point of the treated shale oil.

The smaller than 100 mesh raw oil shale was also treated with fresh shale oil at ambient temperature but there was no change in the oil's pour point. Also spent oil shale (after it had been retorted at 400°–500° C.) was contacted with fresh shale oil but again there was no change in the oil's pour point.

Pour points were measured on a Mectron Autopour. Pour point is generally defined as the lowest temperature at which a liquid will flow when a test container is inverted.

Other temperatures with the preferred range of 25° C.–350° C. can be used and will show analogous improvements i properties of the shale oil. Also times of contacting other than those reported in connection with the data reported in Tables I and II will also yield analogous improvements.

In addition to the process for improving the pour point of shale oil the invention also resides in a mixture comprising a shale oil and a pour point lowering extract from oil shale wherein the mixture has a pour point lower than that of the shale oil by itself.

I claim:

1. Process for lowering the pour point of shale oil comprising:

contacting liquid feed shale oil having an undesirably high pour point with an effective amount of fresh oil shale at a temperature not exceeding the thermal decomposition temperature of kerogen extracted from the oil shale in the contacting, for a sufficient time whereby afterwards the pour point of the resulting shale oil is lower than the pour point of the liquid feed shale oil prior to the contacting.

2. Process according to claim 1 wherein the temperature does not exceed about 350° C.

3. Process according to claim 1 or 2 wherein the weight ratio of oil to shale is in the range of from about 100/1 to about 1/5.

4. Process according to claim 1 or 2 wherein after the contacting between the oil shale and shale oil has resulted in the lowering of the pour point of the feed shale oil, the oil shale and lower pour point shale oil are separated.

5. A mixture prepared by the process of claim 1 or 2.

* * * * *